US009469998B1

(12) United States Patent
Guevara et al.

(10) Patent No.: US 9,469,998 B1
(45) Date of Patent: Oct. 18, 2016

(54) WALL LATH WITH SELF-FURRING RIDGES

(71) Applicants: Herman Guevara, Hollywood, FL (US); Sergio Hernandez, Pembroke Pines, FL (US)

(72) Inventors: Herman Guevara, Hollywood, FL (US); Sergio Hernandez, Pembroke Pines, FL (US)

(73) Assignee: PLASTIC COMPONENTS, INC., Miami, FL (US)

( * ) Notice: Subject to any disclaimer, the term of this patent is extended or adjusted under 35 U.S.C. 154(b) by 0 days.

(21) Appl. No.: 14/557,514

(22) Filed: Dec. 2, 2014

Related U.S. Application Data

(60) Provisional application No. 61/932,393, filed on Jan. 28, 2014.

(51) Int. Cl.

| | |
|---|---|
| ***E04C 2/42*** | (2006.01) |
| ***E04C 5/04*** | (2006.01) |
| ***E04F 15/06*** | (2006.01) |
| ***E04F 19/10*** | (2006.01) |
| ***E04F 13/04*** | (2006.01) |
| ***E04F 21/02*** | (2006.01) |
| *B21F 27/18* | (2006.01) |
| *B21F 27/20* | (2006.01) |
| *E04F 13/08* | (2006.01) |
| *E04C 5/03* | (2006.01) |
| *E04F 13/06* | (2006.01) |
| *B21F 27/22* | (2006.01) |
| *E04B 2/84* | (2006.01) |
| *E04C 5/06* | (2006.01) |

(52) U.S. Cl.
CPC ..... *E04F 13/047* (2013.01); *E04F 21/02* (2013.01); *B21F 27/18* (2013.01); *B21F 27/20* (2013.01); *B21F 27/22* (2013.01); *E04B 2/845* (2013.01); *E04C 5/03* (2013.01); *E04C 5/04* (2013.01); *E04C 5/0627* (2013.01); *E04F 13/04* (2013.01); *E04F 13/045* (2013.01); *E04F 13/068* (2013.01); *E04F 13/0803* (2013.01)

(58) Field of Classification Search
CPC ..... B21F 27/20; B21F 27/18; B21F 27/22
USPC ..... 52/344, 452, 454, 649.1
See application file for complete search history.

(56) References Cited

U.S. PATENT DOCUMENTS

| | | | | |
|---|---|---|---|---|
| 1,891,240 | A * | 12/1932 | Pearce | 52/672 |
| 2,150,338 | A * | 3/1939 | Newport | E04B 1/82 181/290 |
| 2,990,652 | A * | 7/1961 | Santoro | E04B 2/845 52/371 |
| 3,057,271 | A * | 10/1962 | Butler et al. | 52/179 |
| 3,145,001 | A * | 8/1964 | Bruninga | 245/7 |
| 4,062,160 | A | 12/1977 | Christison | |
| 4,734,337 | A * | 3/1988 | Patton | 428/595 |
| 4,879,855 | A * | 11/1989 | Berrenberg | E04B 2/8617 52/309.11 |
| 5,081,814 | A | 1/1992 | Singletary et al. | |
| 5,287,673 | A * | 2/1994 | Kreikemeier | 52/664 |
| 5,481,843 | A | 1/1996 | Kreikemeier | |

(Continued)

*Primary Examiner* — Chi Q Nguyen
(74) *Attorney, Agent, or Firm* — Jackson Patent Group, LLC

(57) ABSTRACT

A lath for use in applying plaster to a substrate. The lath includes a plurality of crossing members forming a substantially planar lattice-like structure with a plurality of openings therein. The crossing members include a plurality of first elongate members extending in a first direction, a plurality of second elongate members that extend laterally and substantially transversely to the first elongate members, and a plurality of self-furring ridges also extending laterally and substantially transversely to the first elongate members and substantially parallel to and interspersed with the second elongate members.

5 Claims, 5 Drawing Sheets

(56) References Cited

U.S. PATENT DOCUMENTS

| | | | | |
|---|---|---|---|---|
| 6,820,387 | B2 | 11/2004 | Sacks et al. | |
| 7,287,356 | B2 | 10/2007 | Sacks et al. | |
| 8,567,153 | B1 * | 10/2013 | Francavilla | 52/741.13 |
| 2003/0029120 | A1 * | 2/2003 | Sacks et al. | 52/660 |
| 2003/0079429 | A1 * | 5/2003 | Rodlin | 52/311.1 |
| 2005/0055949 | A1 * | 3/2005 | Sacks et al. | 52/633 |
| 2005/0115196 | A1 * | 6/2005 | Raymundo et al. | 52/782.1 |
| 2005/0144901 | A1 * | 7/2005 | Egan et al. | 52/782.1 |
| 2005/0257471 | A1 * | 11/2005 | Stevens | 52/443 |
| 2008/0148680 | A1 * | 6/2008 | Jaenson et al. | 52/660 |
| 2008/0176032 | A1 * | 7/2008 | Kerkar | E04F 13/04 428/131 |
| 2009/0031656 | A1 * | 2/2009 | Hunt-Hansen | E04F 13/04 52/344 |
| 2013/0091793 | A1 * | 4/2013 | Pollack | E04B 1/7069 52/302.1 |
| 2014/0013688 | A1 * | 1/2014 | Pollack | D04H 1/4266 52/302.1 |
| 2014/0053495 | A1 * | 2/2014 | Spilchen | 52/664 |
| 2014/0115997 | A1 * | 5/2014 | Brady | E04F 13/045 52/710 |

* cited by examiner

WALL LATH WITH SELF-FURRING RIDGES

This application claims the priority of Provisional U.S. Patent Application Ser. No. 61/932,393 filed Jan. 28, 2014.

FIELD OF THE INVENTION

This invention relates to the reinforcement of viscous materials used in either interior or exterior applications, and more specifically to a lath for accepting and supporting such viscous materials as they are applied and cured to create a finished surface.

BACKGROUND OF THE INVENTION

Stucco, plaster, and similar viscous materials are typically applied to substrates such as plywood sheathing or cementitious materials. Historically, metal laths were secured to vertical substrates by nails or similar fasteners and such laths helped secure the viscous plaster and support the plaster prior to its drying and curing to form a solid surface. However, as metal lath was prone to corrosion by the alkaline plaster, thereby creating unsightly stains in the wall surface, plastic laths have become an acceptable substitute for metal.

Various plastic laths have been proposed for the application of plaster to a substrate. Plastic laths typically include a flexible planar structure that includes a plurality of openings therein for accepting the viscous materials. They are typically secured to the substrate, after which the stucco or plaster in a flowable state is applied thereto. The plurality of openings in the plastic lath enable the viscous material to seep through and make contact with the substrate, which after curing enables bonding of the plaster to the lath and to the substrate.

Although various flexible laths have been proposed, they typically do not provide the desired depth and the desired contact by the lath with the substrate to achieve proper bonding. Accordingly, it would be advantageous to provide a plastic lath that maximizes contact of the viscous materials with the substrate and which furthermore enables the application of the proper desired depth of viscous material applied to the substrate.

SUMMARY OF THE INVENTION

The present invention comprises a lath for use in applying plaster to a substrate. The lath includes a plurality of crossing members forming a substantially planar lattice-like structure with a plurality of openings therein. The crossing members include a plurality of first elongate members extending in a first direction, a plurality of second elongate members that extend laterally and substantially transversely to the first elongate members, and a plurality of self-furring ridges also extending laterally and substantially transversely to the first elongate members and substantially parallel to and interspersed with the second elongate members.

OBJECTS AND ADVANTAGES

Several advantages are achieved with the lath of the present invention, including:

(1) The lath includes self-furring ridges provide exceptional keying for stucco or plaster.

(2) The lath includes a ribbed surface on each of the self-furring ridges.

(3) The lath eliminates the need for furring members to establish a desired depth from the substrate.

(4) The lath is constructed of a flexible plastic that makes it impervious to rust or corrosion when used with an alkaline-based plaster or stucco system.

(5) The lath establishes proper reinforcement for the plaster or stucco layer applied to the substrate.

(6) The lath includes an optimal amount of keys or openings per given area to maximize contact of the viscous materials with the substrate.

(7) The lath is lightweight and impervious to sand and to chemicals found in portland-based stucco or plaster.

These and other objects and advantages of the present invention will be better understood by reading the following description along with reference to the drawings.

BRIEF DESCRIPTION OF THE SEVERAL VIEWS OF THE DRAWING(S)

Reference is made herein to the accompanying drawings, which are not necessarily drawn to scale, and wherein.

DETAILED DESCRIPTION

The present invention comprises a lath for use in applying plaster to a substrate. The lath includes a plurality of crossing members forming a substantially planar lattice-like structure with a plurality of openings therein. The crossing members include a plurality of first elongate members extending in a first direction, a plurality of second elongate members that extend laterally and substantially transversely to the first elongate members, and a plurality of self-furring ridges also extending laterally and substantially transversely to the first elongate members and substantially parallel to the second elongate members.

Figure 1:
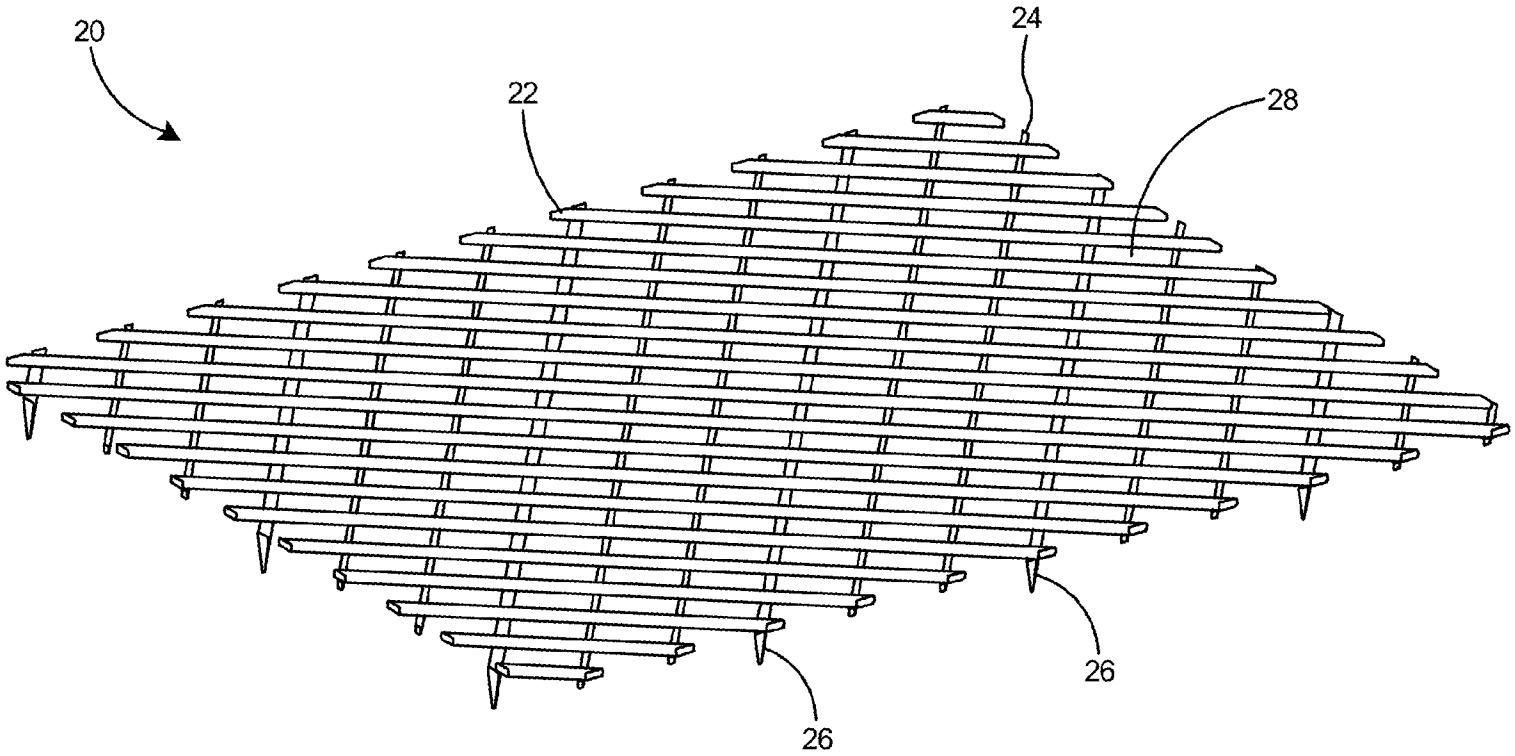
FIG. 1 is an isometric view of a lath in according to the present invention.
Figure 2:
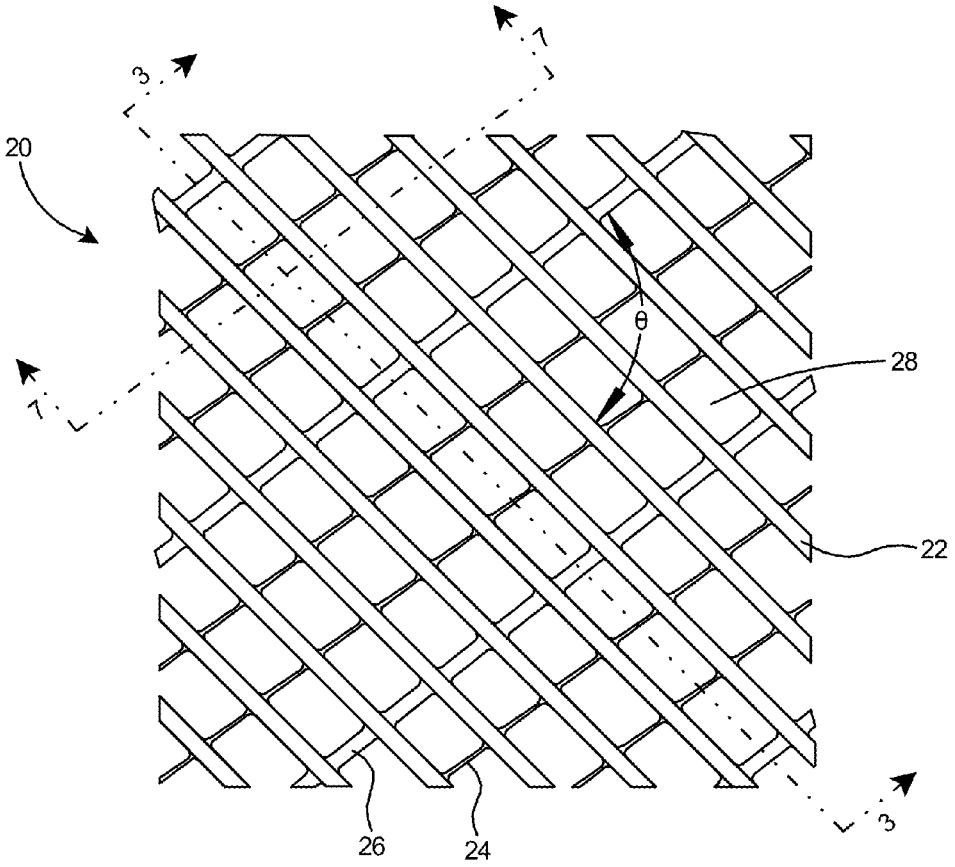
FIG. 2 is a top plan view of the lath of FIG. 1.

With reference to FIGS. 1 and 2, there is shown a lattice-like lath 20 according to the present invention. The lath includes a plurality of elongated first elongate members 22 extending in a first direction and a plurality of narrow second elongate members 24 extending laterally and substantially transversely to and intersecting the first members 22. The second elongate members 24 intersecting the first elongate members 22 at a substantially constant angle θ. The lath 20 also includes a plurality of self-furring ridges 26 extending laterally and substantially transversely to the first members 22 and substantially parallel and interspersed between the second members 24. A plurality of openings or keys 28 are formed by the intersecting first 22, second 24, and self-furring ridges 26. The angle θ of intersection between the second elongate members 24 and first elongate members 22 is preferably between 75 and 90 degrees.

In the preferred embodiment, each self-furring ridge 26 is most preferably separated by two or more second members 24. As shown in FIG. 2, as viewed from the top of the lath, the second members 24 are substantially narrower than the self-furring ridges 26.

Figure 3:
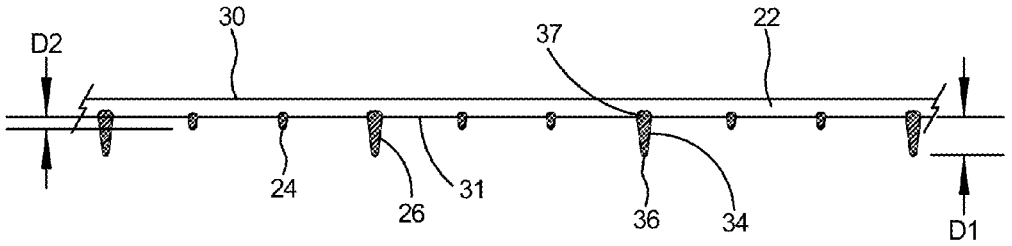
FIG. 3 is a sectional view of the lath taken along line 3-3 of FIG. 2.

Referring to FIG. 3, the plurality of first members 22 form a substantially planar outer surface 30 on the lath 20. The self-furring ridges 26 extend a substantially longer distance D1 from the inner end 31 of the first members 22 than the distance D2 the second members 24 extend from the inner end 31. Each self-furring ridge 26 includes tapered sides 34 and an end 36. The sides of the self-furring ridge 26 taper from a wide width at the juncture 37 with the first member 22, to a narrow width at the end 36.

Figure 4:
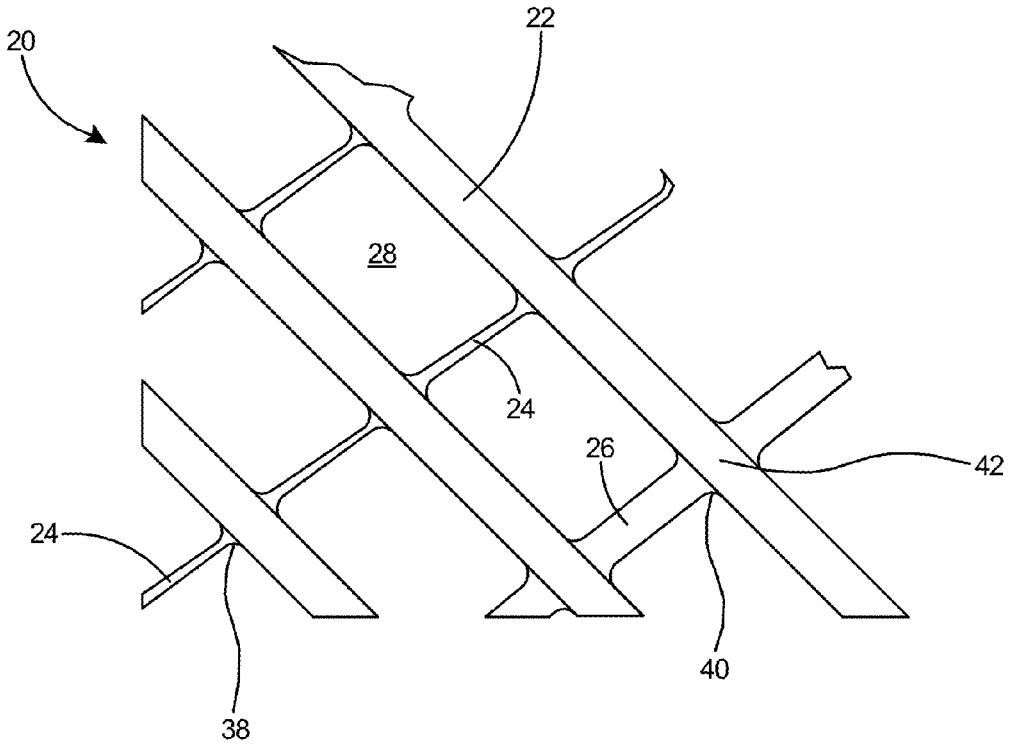
FIG. 4 is a detail view of a portion of the lath depicted in FIG. 2.

With reference to FIG. 4, a first filet 38 is formed at the juncture of second member 24 with first member 22 and a second filet 40 is formed at the juncture or joint 42 of the self-furring ridge 26 and the first member 22. The filets 38 and 40 increase the strength of the lattice-like lath 20 at the joints 42.

Figure 5:
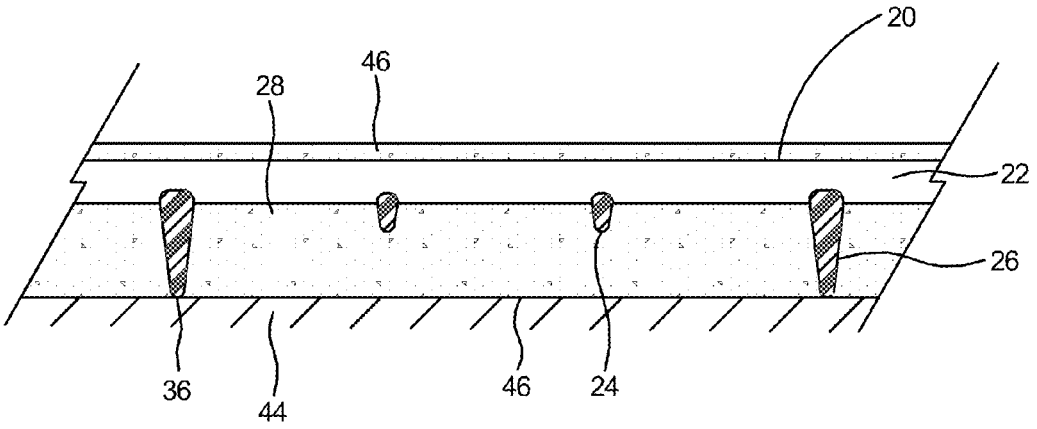
FIG. 5 is a sectional view of the lath of the present invention in contact with a substrate and with plaster applied thereto.

Referring to FIG. 5, the lath 20 is used to provide a structure for plaster to adhere to, such as on a vertical wall. The lath 20 is first positioned on the wall with ends 36 of third members or self-furring ridges 26 pressed flush against the substrate 44. The lath 20 is secured to the substrate 44 with nails or similar fasteners (not shown). Plaster 46 is then spread on the lath by trowel, spraying, or similar means. Plaster spreads through the openings 28 in the lath and fills the spaces between the first 22, second 24, and self-furring ridges 26. After drying, the lath becomes an integral part of the plaster or stucco layer 46.

The long self-furring ridges 26 provide a substantial standoff from the substrate thereby creating a large volume to be filled with plaster. By separating each self-furring ridge 26 with two or more short second members 24, a substantial reduction in cost of production is achieved over laths including equally sized crossing members. The amount of plastic required for constructing the lath is lessened substantially by the lesser number of crossing members required to achieve the standoff.

Figure 6:
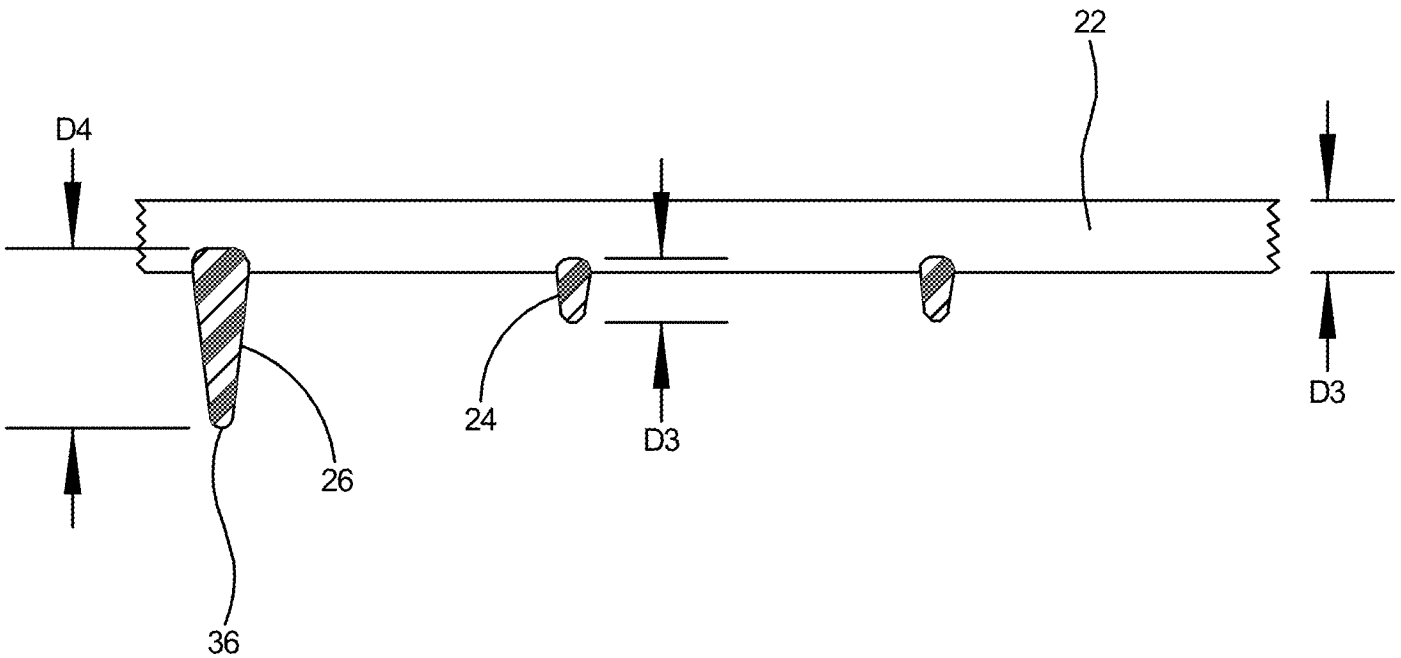
FIG. 6 is a detail view of a portion of the section depicted in FIG. 3.

With reference to FIG. 6, the first members 22 and the second members 24 preferably each include a thickness D3 of 0.04 to 0.06 inch. Most preferably, the thickness D4 of the self-furring ridges 26 is preferably at least 0.20 inch. Thus the self-furring ridges 26 are 3 to 5 times the thickness of the second members.

Figure 7:
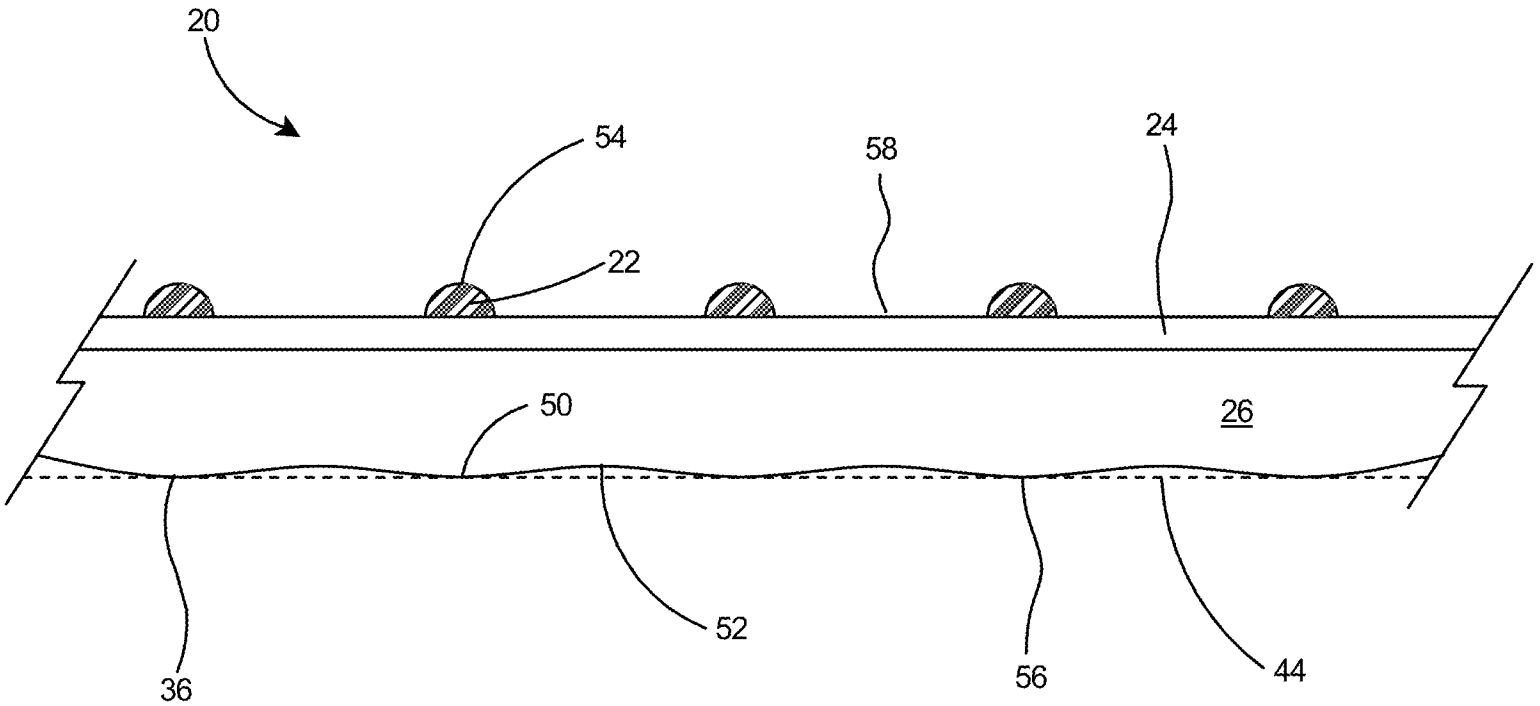
FIG. 7 is a sectional view of the lath taken along line 7-7 of FIG. 2.

As shown in FIG. 7, each self-furring ridge 26 includes a series of ribs 50 and troughs 52 along the end 36 of the self-furring ridge 26. First members 22 include arcuate outer surfaces 54. The end 36 of the self-furring ridge 26 includes a ribbed surface 56 and arcuate outer surfaces 54 of first members 22 form an outer side 58 of the lattice-like lath 20.

To operate the invention, the ribbed surface 56 of the lattice-like lath 20 is placed against the outer surface of the substrate 44 as shown in FIG. 7. The ribs 50 of ribbed surface 56 provide contact with the substrate 44 and position first members 22 away from the substrate. The lattice-like lath 20 is then secured to the substrate 44 by nails or similar fasteners. Adjacent pieces of lath may be secured together by wire ties or cable ties. The ribbed surface 56 holds the outer side 58 of the lath 20 at the proper distance from the substrate 44 to aid in keying of stucco or plaster to the lath.

The lath 20 of the present invention is preferably constructed of plastic, is flexible, and may be flexed across its length or width. According to the present invention, a length of lath may be rolled into a roll for shipment and storage prior to shipment to a job site. With reference to FIG. 1, most preferably the lath includes between 11,000 and 12,000 openings or keys 28 per square yard.

The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A lath for providing support for the application of a viscous flowable material onto a substrate comprising:
- a plurality of first members, said first members elongated, said first members including an arcuate outer surface with a maximum extent;
- a plurality of second members intersecting said first members at a substantially constant angle, said second members elongated;
- a plurality of linear self-furring ridges extending laterally and transversely to said first members, said self-furring ridges parallel with the second members and interspersed between the second members, said self-furring ridges include tapered sides and an end;
- a juncture at the intersection of said second members and said first members and a juncture at the intersection of said self-furring ridge with said first members;
- a first filet at the juncture of said second member with said first member and a second filet at the juncture of said self-furring ridge and said first member;
- said end of said self-furring ridge includes a ribbed surface including a series of ribs and troughs extending longitudinally along the end of each self-furring ridge;
- said second members and said self-furring ridges evenly spaced from one another across said lath;
- said lath constructed of flexible plastic; and
- said maximum extent of said arcuate outer surface of said first members reside in a common plane.

2. The lath of claim 1 including a plurality of keys formed by said first members intersecting with said second members and said self-furring ridges.

3. The lath of claim 2 wherein said lath includes between 11,000 and 12,000 of said keys per square yard.

4. The lath of claim 1 wherein
- said first members include inner ends; and
- said self-furring ridges extend a longer distance from the inner ends of the first members than do said second members.

5. The lath of claim 1 wherein each of said self-furring ridges is separated by two of said second members.

* * * * *